US006446395B2

(12) United States Patent
Rogers

(10) Patent No.: US 6,446,395 B2
(45) Date of Patent: Sep. 10, 2002

(54) SAFETY GATE

(75) Inventor: John Rogers, Stafford (GB)

(73) Assignee: Beldray Limited, Bilston (GB)

( * ) Notice: Subject to any disclaimer, the term of this patent is extended or adjusted under 35 U.S.C. 154(b) by 0 days.

(21) Appl. No.: 09/834,127

(22) Filed: Apr. 12, 2001

(30) Foreign Application Priority Data

Apr. 15, 2000 (GB) ..... 0009253

(51) Int. Cl.[7] ..... E06B 3/32; E06B 3/68

(52) U.S. Cl. ..... 49/463; 49/55; 49/57; 160/215; 292/DIG. 29

(58) Field of Search ..... 49/463, 50, 57, 49/465, 464, 55, 56, 394; 160/217, 215, 222; 292/175, 164, DIG. 29

(56) References Cited

U.S. PATENT DOCUMENTS 3,469,875 A * 9/1969 Ahlgren ..... 292/175
4,226,452 A * 10/1980 Hoffman et al. ..... 292/175
4,583,715 A * 4/1986 Wright ..... 49/55 X
4,611,431 A * 9/1986 Lauro ..... 49/55
5,117,585 A * 6/1992 Andrisin, III ..... 49/55
5,146,632 A * 9/1992 Li ..... 292/175 X
6,112,461 A * 9/2000 Cheng ..... 49/55
6,176,042 B1 * 1/2001 Rossman et al. ..... 49/463
6,253,490 B1 * 7/2001 Postans ..... 49/55
6,296,041 B1 * 10/2001 Cicero ..... 49/50 X
6,301,832 B1 * 10/2001 Andersen ..... 49/57

FOREIGN PATENT DOCUMENTS

GB 2234281 * 1/1991 ..... 49/50 X

* cited by examiner

*Primary Examiner*—Daniel P. Stodola
*Assistant Examiner*—Hugh B. Thompson
(74) *Attorney, Agent, or Firm*—Barnes & Thornburg

(57) ABSTRACT

A safety gate (10) comprises a frame (12) and a gate part (14) pivotally mounted on the frame (12). The frame (12) is adapted to be mounted across a space, for example in a doorway. The frame (12) defines an opening closed off by the gate part (14). The gate part comprises a latch (24) engageable with a keep (44) on the frame (12). The gate (10) also comprises an engaging member (64) on the gate part (14) for engaging the frame (12). The gate (10) thus requires two actions to open—unlatching of the latch (24) from the keep (44) and disengagement of the engaging member (64) by movement of the gate part (14) preferably in a non-opening direction of the gate (10), i.e., upwardly.

14 Claims, 2 Drawing Sheets

SAFETY GATE

The invention relates to a safety gate and particularly to but not exclusively limited to a safety gate used to confine a child or animal in a particular area.

A known safety gate comprises a U-shaped frame having a first arm and a second arm joined by a body. The U-shaped fame is adapted to be mounted substantially upright across a space between two opposite surfaces. The frame has an opening between the arms and the body which opening allows passage through the space. A gate part is pivotally mounted on the U frame, in such a way that it can close off the opening to prevent access therethough. The safety gate also comprises a fixed keep on the frame and fixed actuating member on the gate part. The safety gate is adapted so that the lifting of the gate part lifts the actuating member from the keep allowing subsequent opening of the gate part. Afterwards, the person can close the gate part, lifting the gate part as they do so that the actuating member can move back into the keep. In the closed state access through the space is prevented. The opening of the gate is intended to be straightforward for adults but not possible for young children.

A problem with the known safety gate is that the gate part need only be lifted relative to the U frame to allow opening thereof A straightforward opening action can soon be learnt by a child.

An object of the invention is to provide an improved safety gate.

According to a first aspect of the invention there is provided a safety gate comprising a frame and a gate part pivotally mounted—on the frame, the frame adapted to be mounted across a space between walls or the like, and defining an opening which a person can move through, the gate part being arranged to close off the opening, the gate part or the frame comprising a latch engagable with a keep on the other of the gate part or the frame, the safety gate also comprising an engaging means arranged so as lo engage the frame with the gate part whereby the latch can be moved out of the keep and the gate part subsequently moved to disengage the gate part from the frame so that the gate part can be moved relative to the frame so as to open up the opening.

Such an arrangement means that to open the gate part it must be unlatched from the frame and then separately disengaged from the frame. That tends to avoid easy and/or accidental opening by a child.

The latch is biased into the keep, most preferably it is biased by a spring. The spring is a helical compression spring.

The latch has means for improving grip thereof defined thereon, most preferably in the form of a lug.

Preferably, the latch is on the gate part and the keep is on the frame. In that way, regardless of latch position, the latch can be actuated and the gate part opened with just one hand.

Preferably, the latch is protected by a casing, preferably the casing defines an opening through which the latch is actuable, and most preferably the opening is uppermost so as to make access difficult for small children and facilitate easy opening for adults.

Preferably, the casing has one or more abutment surfaces acting so as to limit movement of the latch under the biasing means in one axial direction only.

Preferably, the casing provides an abutment surface for the biasing means.

The engaging means comprises a formation on one of the gate or frame engagable with part of the other of the gate or frame such that movement of the gate relative to the frame disengages the engaging means.

Preferably, the movement of the gate relative to the frame to disengage the engaging means is movement in a non-opening direction of the gate.

The engaging means comprises a channel member which engages around part of the gate or frame. The channel member is arranged on the gate so as to engage the frame.

In one embodiment of the invention the frame is located in the opening by means of pads retained on screw threaded shanks whereby the pads can be screwed outwardly in opposite directions against opposing wall surfaces so that the frame is retained by frictional contact. In such a case, the frame is arranged to bend inwardly when the pads are screwed outwardly against the respective wall surfaces.

In a preferred embodiment of the invention, a plurality of cups are provided for attachment to the respective wall surface such that the recesses of the cups face inwardly. The cups may be fixed to the wall with fasteners such as screws of adhesive pads. In such a case, the pads are screwed outwardly until they engage the cup recesses.

An indicator is provided to show when the pads have been screwed out sufficiently.

Preferably, the indicator comprises a first part movable with the frame and a second part on the gate such that the relative position between the first and second parts act as the indicator. The indicator indicates the appropriate amount of movement of the frame relative to the gate. Most preferably, the indicator comprises the latch and casing whereby the latch carries a mark and the casing carries a reference mark whereby movement of the fame relative to the gate causes the latch to move relative to the casing, the appropriate position of the frame being indicated by alignment of the latch mark and the casing mark.

According to a second aspect of the invention there is provided a safety gate comprising a frame having a first arm and a second arm Joined by a body, and a gate part pivotally mounted on the first arm, the frame being arranged to span the space between two surfaces, each arm being arranged to lie adjacent a respective surface the gate having an indicator thereon, the gate having adjustable securing means thereon whereby, as the adjustable securing means is applied the distance between at least one arm and/or each respective wall is varied, thereby varying the distance between the two arms themselves, and consequently varying the distance between the gate and the second arm, the indicator indicating the correct position of the securing means.

In that way rather than attempting to measure or look at the space between the gate part and the frame a person can simply look at the indicator which will tell them whether further adjustment is necessary to achieve an optimum space between the gate part and the frame.

The indicator is in the form of a measurement scale which a user can read from to select an appropriate distance, but preferably the indicator comprises a mark which corresponds to the space between the gate part and the frame, most preferably the indicator comprises second and third indicia sandwiching the mark, one indicia indicating that tightening is required, another indicia indicating tat loosening is required and the mark indicating that distance between parts is optimal.

A latch may be provided for latching the gate part shut on the frame. The latch may be housed in a casing. Preferably, the indicator is on the latch.

Preferably, the indicator is in the form of a strip having the indicia thereon. Most preferably the indicator is a sticker on the latch. The indicator is preferably viewed through an opening in the casing.

A safety gate in accordance with the invention will now be described with reference to the drawings in which.

Figure 1:
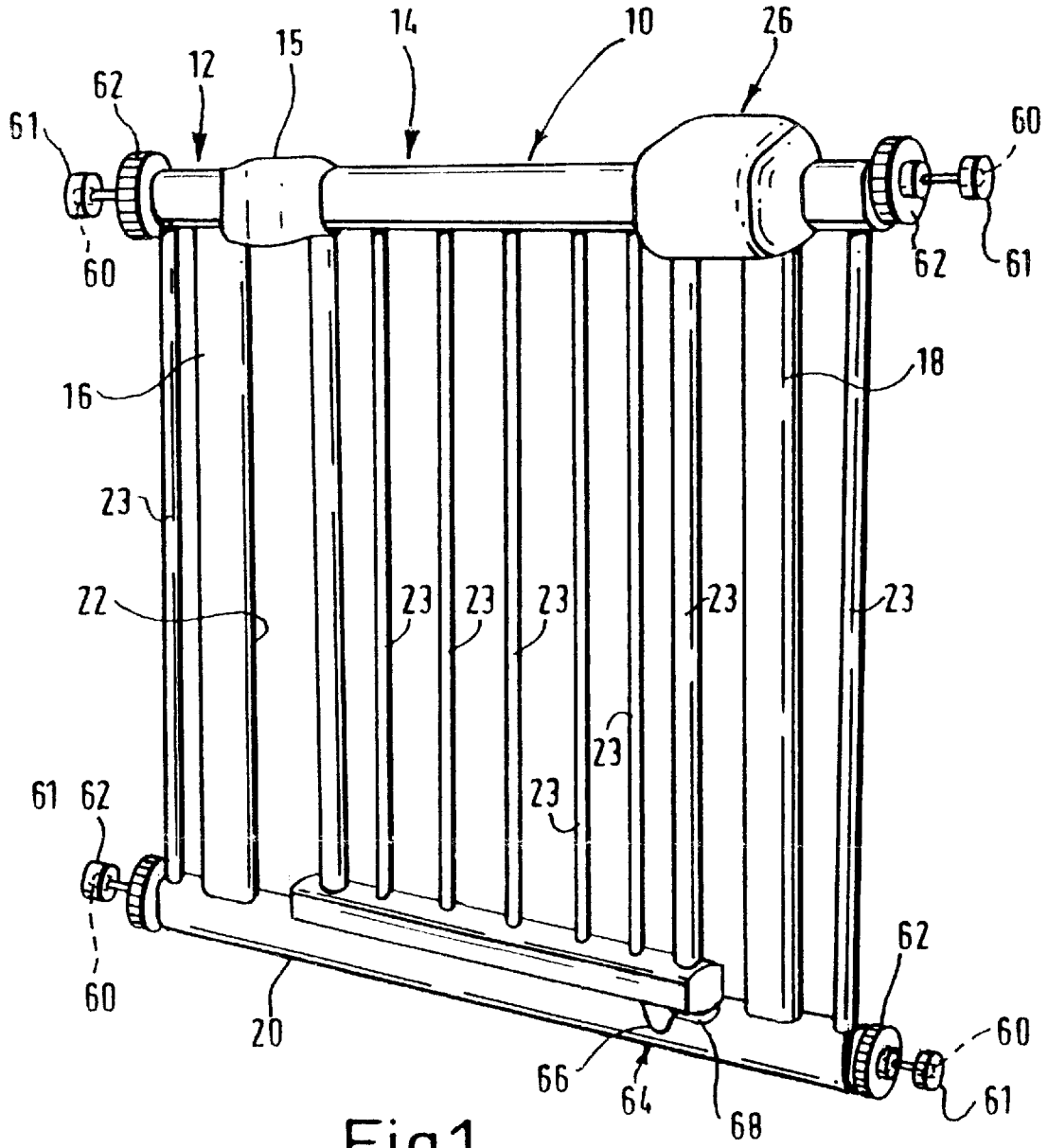
FIG. 1 is a perspective view of the safety gate.

Referring to FIG. 1 a child safety gate 10 comprises a U-shaped frame 12 and a gate part 14.

The U-shaped frame 12 comprises a first arm 16 and a second arm 18 which are joined by a body 20. The arms 16, 18 and the body 20 are of tubular form. The arms 16, 18 are welded together so as to taper slightly away from each other towards the free ends thereof. An opening 22 is defined with the arms 16,18 and the body 20. The fame 12 is adapted to span between two walls by (not shown) in an upright fashion.

The gate part 14 is slidably and pivotally mounted at pivot 15 on the frame 12, towards the free end of the first arm 16.

The gate part 14 is pivotal away and towards the second arm 18 so as to free the opening 22 and cover the opening respectively.

Rails 23 are provided on the gate part 14 and the frame 12.

Figure 2:
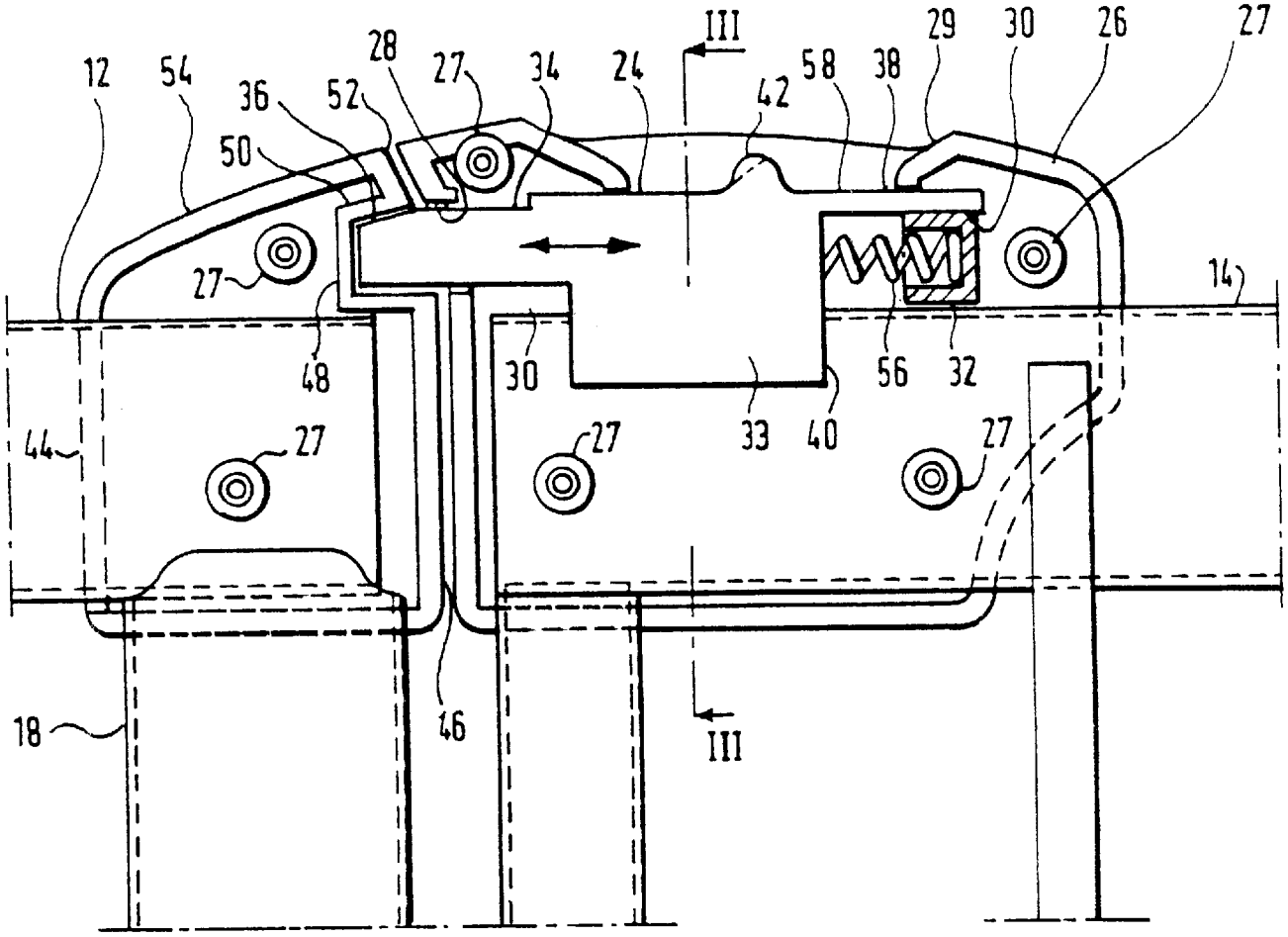
FIG. 2 is a cross-section of part of the safety gate in accordance with the invention.
Figure 3:
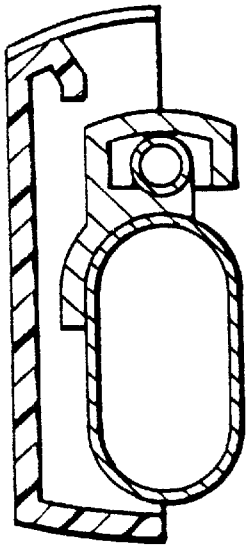
FIG. 3 shows part of the safety gate of FIG. 2 along line III—III.

Referring to FIGS.1 and 2, the gate part 14 comprises a latch 24 in a housing 26.

The housing 26 is mounted on the gate part 14 so as to locate adjacent the free end of the second arm 18 when the gate part 14 is closed.

The housing 26 of the latch 24 is made of plastics, say by moulding in two parts (only one of which is shown in FIG.2) which are then fastened together, for example with screws at 27 through the gate part 14. The housing 26 defines a first opening 28 through which the latch 24 moves to latch and unlatch, a mouth 29 for a user to operate latch 24 and inner walls 30 which restrict the latch so that it can move only in the plane of the gate part 14. The housing 26 further defines a pocket 32.

The latch 24 comprises a hollow latch body 33 having a protruding pin 34 with a narrowing tapered end 36, a locator arm 38, an abutment surface 40 and a projecting lug 42.

The U frame 12 comprises a keep 44 for the latch pin 34.

The keep 44 is in the form of a housing made in a similar way to the latch housing 26 (ie of moulded plastics in Two halves screwed together at 27). The keep 44 has a facing surface 46 which faces the latch housing 26. The facing surface 46 defines a cup 48 Which is adapted to receive the pin 34. An upper surface 50 of the cup 48 is tapered to match the taper on the tapered end 36 of the pin 34. The facing surface 46 has a sliding surface 52 extending from the upper surface 50 of the cup 48 to an upper surface 54 of the keep 44.

A biasing means in the form of a helical compression spring 56 is provided. The compression spring 56 is arranged so that one end sits in the pocket 32 and the other end extends into the hollow body 33 of the latch 24. Thus, the latch 24 is biased outwardly of the housing 26 through the opening 28.

The latch 24 has an indicator 58 in the form of a sticker on the locator arm 38 arranged so that it can be viewed through the mouth 29. The sticker is accurately placed according to experimental measurements. The sticker 58 is coloured and/or contrasted to give three distinct regions. One region located towards the right as viewed in FIG. 2 is designated "further tightening required", another region located towards the left in FIG. 2 is designated "further loosening required" and an intermediate region designated "no further adjustment".

Referring to FIG. 1, the U frame 12 has adjustment means thereon in the form of four wall clamps 60 adjustable by respective wheels 62. The clamps 60 are positioned at the four comers of the safety gate 10, ie one adjacent each end of each arm 16, 18.

An engaging means 64 is provided to allow engagement of the gate part 14 with the frame 12 when the gate part 14 is closed against the frame 12. The engaging means 64 is in the form of a cavity 66 on the fame 12 and an engaging pin 68 on the gate part 14.

In use, the child safety gate 10 is positioned between two facing walls or the like (not shown).

To fix the child safety gate 10 in position the wheels 62 are adjusted to locate the clamps 60 into cups 61 affixed to the surfaces of the walls. Alternatively, the wheels 62 are adjusted to locate the clamps 60 on respective surfaces of the walls themselves. In the latter case when the clamps 60 are tightened, the pressure they impart on the wall is sufficient to hold the safety gate 10 rigidly against the wall. The pressure causes arms 16, 18 to flex inwardly. The adjustment of the clamps 60 must be controlled so that a gap between the gate part 14 and the frame part 12 remains, and in particular a gap between the latch housing 26 and the keep 44 is maintained to allow (unobstructed) opening of the gate part 14. As adjustment is applied to the safety gate 10 the distance between at least one arm 16, 18 and a respective wall is varied, thereby varying the distance between the latch housing 26 and the keep 44.

Since the latch pin 34 is biased into the cup 48, inward movement of arm 18 forces the latch 24 back against the spring 56. The sticker 58 on arm 38 is thus moved inwardly of the casing. The markings on the exposed informs the user whether or not further adjustment of the clamps 60 is required.

To use the child safety gate, the latch 24 must be moved to the right as shown in FIG. 2 against the spring 56 out of the cup 48. The latch 24 is held open and the gate part 14 is lifted relative to the fixed frame 12. Such lifting causes the engaging pin. 68 to depart from the cavity 66. The gate part 14 can then be pivoted open about pivot 15 to allow a person to step therethrough. It can be closed, if desired, afterwards by closing the gate part 14 relative to the frame about the pivot 15, slightly retracting pin 34 so as to locate the sliding surface 56, and applying a small downward force to snap the latch back into a latched position as shown in FIG. 1.

It will be appreciated that other biasing means 56 could be used instead of a spring.

It will be appreciated that the indicator 58 could comprise an audible signal to help the deaf. The latch could also be provided with a textured surface which could be read like Braille so that the safety gate could be used by a deaf and blind person.

What is claimed is:

1. A safety gate comprising a frame and a gate part pivotally mounted on the frame, the frame adapted to be mounted across a space between walls and defining an opening which a person can move through, the gate being arranged to close off the opening, the gate part or the frame comprising a latch engagable with a keep on the other of the gate part or the frame, the safety gate also comprising an engaging means arranged so as to engage the frame with the gate part whereby the latch can moved out of the keep and the gate part subsequently moved to disengage the gate part from the frame so that me gate part can be moved relative to the frame so as to open up the opening, and wherein the frame is adapted to be located in the opening by means of pads retained on screw threaded shanks whereby the pads can be screwed outwardly in opposite directions against opposing wall surfaces so that the frame is retained by frictional contact, an indicator provided to show when pads have been screwed out, wherein the indicator comprises a first part movable with the frame and a second part on the gate such that the relative position between the first and second parts acts as the indicator, and wherein the indicator comprises the latch and casing whereby the latch carries a mark and the casing carries a reference mark whereby movement of the frame relative to the gate causes the latch to move relative to the casing, the appropriate position of the frame being indicated by alignment of the latch mark and the casing mark.

2. The safety gate according to claim 1 in which the latch is biased into the keep.

3. The safety gate according to claim 2 in which the latch is biased by means of a helical compression spring.

4. The safety gate according to claim 1 in which the latch has means for improving grip thereof defined thereon.

5. The safety gate according to claim 4 in which the means for improving grip comprises a lug.

6. The safety gate according to claim 1 in which the latch is on the gate part and the keep is on the frame.

7. The safety gate according to claim 1 in which the latch is protected by a casing.

8. The safety gate according to claim 7 in which the casing defines an opening through which the latch is actuable.

9. The safety gate according to claim 8 in which the opening is uppermost so as to make access difficult for small children and facillitate easy opening for adults.

10. The safety gate according to claim 1 in which the engaging means comprises a formation on one of the gate or frame engagable with part of the other of the gate or frame such that movement of the gate relative to the frame disengages the engaging means.

11. The safety gate according to claim 1 in which the movement of the gate relative to the frame to disengage the engaging means is movement in a non-opening direction of the gate.

12. The safety gate according to claim 1 in which the engaging means comprises a channel member which engages around part of the gate or frame.

13. The safety gate according to claim 12 in which the channel member is arranged on the gate so as to engage the frame.

14. The safety gate according to claim 1 in which the frame is flexible and permitted to bend inwardly when the pads are screwed outwardly against the respective wall surfaces so as to retain the frame resiliently in the opening.

* * * * *